US006296069B1

(12) United States Patent
Lamine et al.

(10) Patent No.: US 6,296,069 B1
(45) Date of Patent: Oct. 2, 2001

(54) BLADED DRILL BIT WITH CENTRALLY DISTRIBUTED DIAMOND CUTTERS

(75) Inventors: Etienne Lamine, Court-Saint-Etienne; Robert Delwiche, Brussels, both of (BE)

(73) Assignee: Dresser Industries, Inc., Carrollton, TX (US)

( * ) Notice: Subject to any disclaimer, the term of this patent is extended or adjusted under 35 U.S.C. 154(b) by 0 days.

(21) Appl. No.: 09/319,559

(22) PCT Filed: Dec. 16, 1997

(86) PCT No.: PCT/BE97/00135

§ 371 Date: Jul. 19, 1999

§ 102(e) Date: Jul. 19, 1999

(87) PCT Pub. No.: WO98/27310

PCT Pub. Date: Jun. 25, 1998

(30) Foreign Application Priority Data

Dec. 16, 1996 (BE) ..... 9601043

(51) Int. Cl.[7] ..... E21B 10/36

(52) U.S. Cl. ..... 175/434; 175/348; 175/373; 175/398

(58) Field of Search ..... 175/376, 398, 175/348, 373, 351, 374, 405.1, 428, 434

(56) References Cited

U.S. PATENT DOCUMENTS 4,604,106 * 8/1986 Hall et al. ..... 51/293
4,858,706 8/1989 Lebourg .
4,943,488 * 7/1990 Sung et al. ..... 428/552
4,991,670 * 2/1991 Fuller et al. ..... 175/329
5,099,929 * 3/1992 Keith et al. ..... 175/61
5,135,061 * 8/1992 Newton, Jr. ..... 175/428

FOREIGN PATENT DOCUMENTS 1330147 12/1963 (FR) .

* cited by examiner

*Primary Examiner*—William Neuder
*Assistant Examiner*—Zakiya Walker
(74) *Attorney, Agent, or Firm*—Browning Bushman PC.

(57) ABSTRACT

A drill bit as used in particular in the oil well drilling field comprising a central body (2), cutting blades (3) protruding with respect to the body (2), both at the front of this body according to a drill direction and at the sides of this same body (2), and cutting elements (9) divided over an outer front surface (10) and over an outer lateral well sizing surface (11) comprised by each blade (3), wherein there are provided as cutting elements: in a central area (13) of the front surface (10), on at least one blade (3): at least one synthetic polycrystalline diamond compact cutting disc (12), and in a remaining area (14) of the front surface (10) of this blade, situated beyond said central area (13) with respect to the rotation axis, and on the other blades: thermally stable synthetic diamonds and/or impregnated diamond particles.

31 Claims, 4 Drawing Sheets

BLADED DRILL BIT WITH CENTRALLY DISTRIBUTED DIAMOND CUTTERS

The present invention concerns a drill bit as used in particular in the oil well drilling field comprising:

a central body, cutting blades protruding with respect to the body, both at the front of this body according to a drill direction and at the sides of this same body, and cutting elements divided over an outer front surface and over an outer lateral well sizing surface, the outer lateral surfaces of the blades being part of a substantially cylindrical surface.

The drill bits used nowadays can be provided with different types of cutting elements. Amongst these elements a distinction can generally be made between synthetic polycrystalline diamond discs or PDC (Polycrystalline Diamond Compact), so-called impregnated natural or synthetic diamonds, abrasive grits in general and so-called thermally stable (synthetic) diamonds or agglomerates of abrasive grits or agglomerated abrasive grits.

Each type of cutting element shows of course advantages and disadvantages related to the position of the cutting element on the drill bit.

The present invention results from a comparative study of the advantages and disadvantages of the cutting elements in function of their position on the drill bit, in particular on the front side thereof. It appears for example that, in case of a drill bit comprising only impregnated diamond particles in the front side, the particles on the rotation axis or very near thereto have a small peripheral speed during the rotation of the drilling bit. Moreover, their cutting depth in a formation to be drilled is very low because these particles have small dimensions (maximally 0.6 to 1 mm) and are mechanically set in the bit by a bond so that they protrude generally only at the most 0.4 mm from the setting bond. Consequently, the rate of penetration (ROP in meters per hour) is very small at least due to the particles on or very near to the rotation axis. A small peripheral rotational speed of the diamond particles may also involve an increased pressure thereon and hence a higher risk of chipping or of tearing away the particles which are very near to the axis.

However, at a distance from the axis, a very high value in carats of diamonds is obtained with respect to what could be obtained in a drill bit configuration with PDC discs thanks to the impregnated particles.

A drill bit with PDC discs appears, on the contrary, to be very advantageous at the place of, or very near to, the rotation axis because the value in carats of diamond is sufficient there, the exposure of the cutting discs projecting with respect to the rest of the bit assures cutting depths per revolution which are considerable and these discs offer a higher resistance to said pressure than diamond particles So, the present invention resulted from a searching examination of the behaviour of different cutting elements in different places on the front side of the drill bits, according to which invention there are provided as cutting elements on the outer front surface of the blades:

in a central area of the outer front surface of at least one blade: at least one synthetic polycrystalline diamond compact cutting disc, and in a remaining area of the outer front surface of this blade, situated around said central area, and on the other blades: thermally stable synthetic diamonds and/or impregnated diamond particles.

According to an advantageous embodiment of the invention, said remaining area is divided into two substantially circular areas, which are coaxial to said central area, and one of the circular areas comprises as cutter element, thermally stable synthetic diamonds, whereas the other circular area comprises impregnated diamond particles.

Other details and particularities of the invention will become apparent from the secondary claims and from the description of the drawings which are annexed to the present specification and which illustrate, by way of non-limiting examples, a preferred embodiment of the invention.

FIGS. 4 and 5, 6 and 7, 8 and 9 are each time, on the one hand, schematic cross-sectional elevational views and, on the other hand, respectively schematic views of the front side of three different drill bits of the prior art cited here by way of comparison to demonstrate the technical advantage of the drill bit of the invention with respect thereto.

Figure 1:
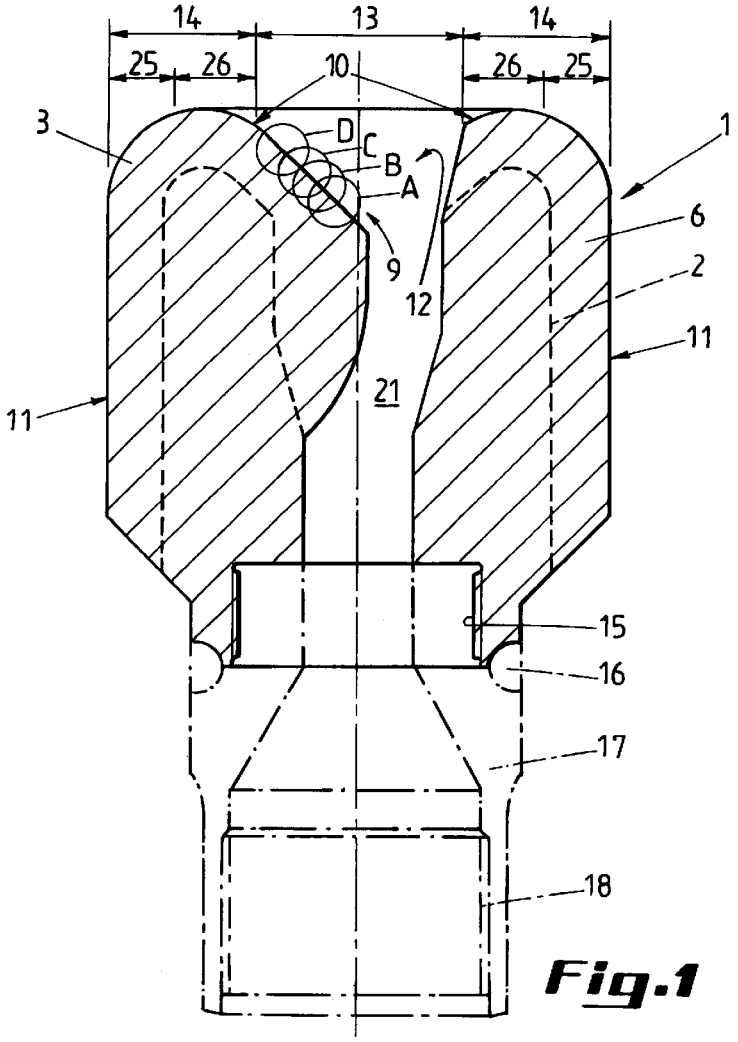
FIG. 1 is a schematic cross-sectional elevational view according to line I—I of FIG. 2 of a drill bit of the invention.
Figure 10:
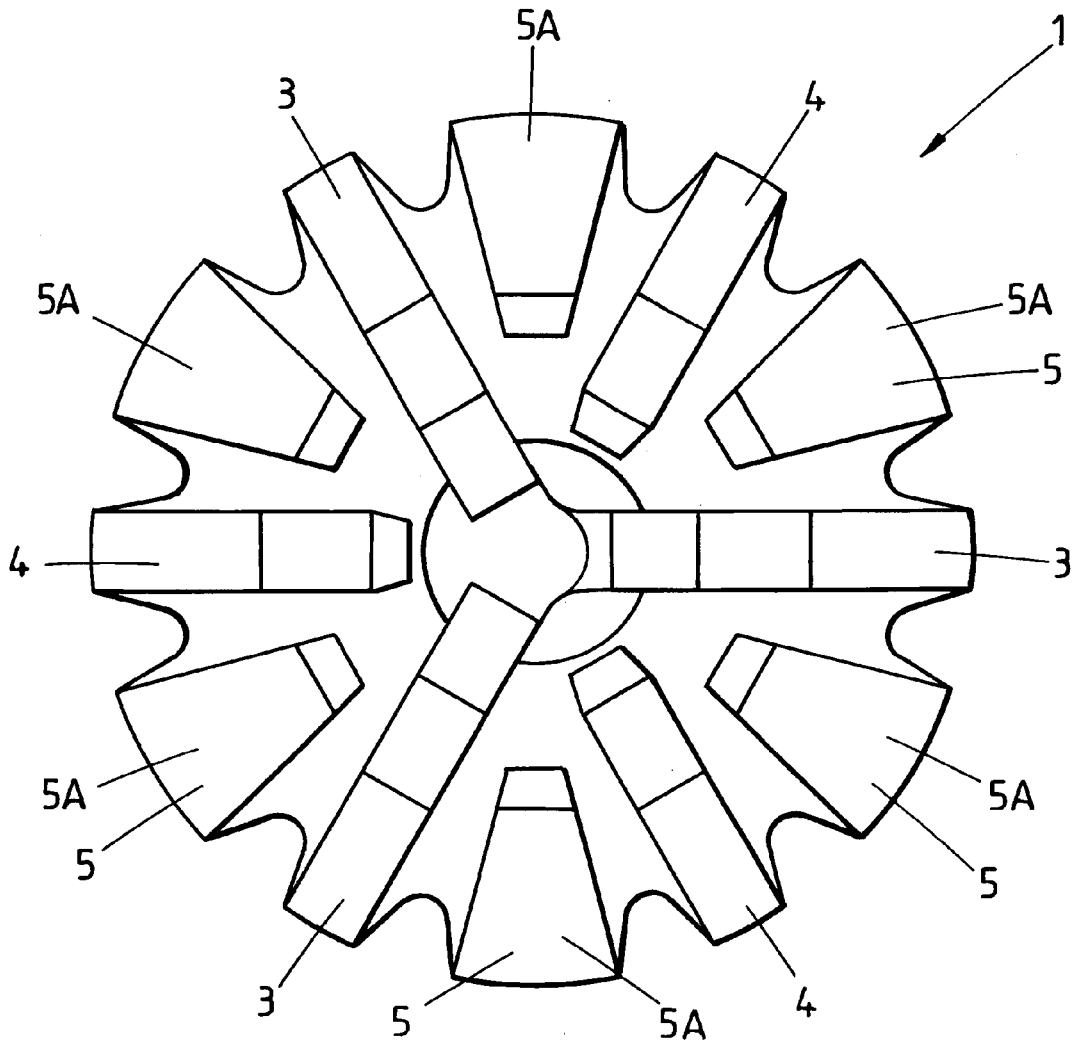

FIG. 10 is, on a larger scale, a view similar to the one of FIG. 1, but schematised and relating to a drill bit, some blades of which have a constant width and others have a variable width increasing as from their extremity situated the closest to the rotation axis.

In the different figures, the same reference numerals indicate identical or analogous elements.

The drill bit 1 of the invention may comprise a substantially cylindrical central body 2 and cutting blades 3 to 8 protruding with respect to the body 2, both in front thereof according to a drilling direction and on the sides of the same body 2. The cutting elements 9 are divided over the outer front surfaces 10, considering the drilling direction, and over the outer lateral surfaces 11 for sizing the hole, for example the oil well to be drilled, the blades 3 to 8 comprising these outer surfaces 10, 11. The outer lateral surfaces 11 are part of a substantially cylindrical surface having an axis coinciding with the rotation axis of the drill bit 1. The outer front 10 and lateral 11 surfaces of each blade 3 to 8 preferably fit together according to a gradual curve.

According to the invention, there is provided on the outer front surface 10 of at least one of the blades 3 to 8 (FIGS. 1 and 2) as cutting elements 9 at least one synthetic polycrystalline diamond compact cutting disc 12 (PDC) at the location of a central area 13 of said outer front surface 10 and, in a remaining area 14 of this front surface 10, outside the central area 13, thermally stable synthetic diamonds and/or impregnated diamond particles, both on the blade 3 to 8 provided with cutting disc(s) 12 and on the other blades 3 to 8.

For the rest, the man skilled in the art knows how to make this drill bit 1, for example by infiltration of molten metal in a matrix of tungsten carbide powder placed in a carbon mould and provided, before infiltration, with diamond particles and/or with thermally stable synthetic diamonds there where they are desired. Then, the cutting disc or discs 12 can be soldered to their places provided during the moulding and the infiltrated and cooled matrix can be fixed (FIG. 1), by screwing (in 15) and/or welding (in 16) to a metallic body 17 carrying a thread 18 for connecting the bit 1 to a drill-pipe string (not shown). Such a soldering of the cutting disc 12 can be done practically in the last place, on the finished bit 1 by means of a silver soldering alloy with a low melting temperature.

Figure 2:
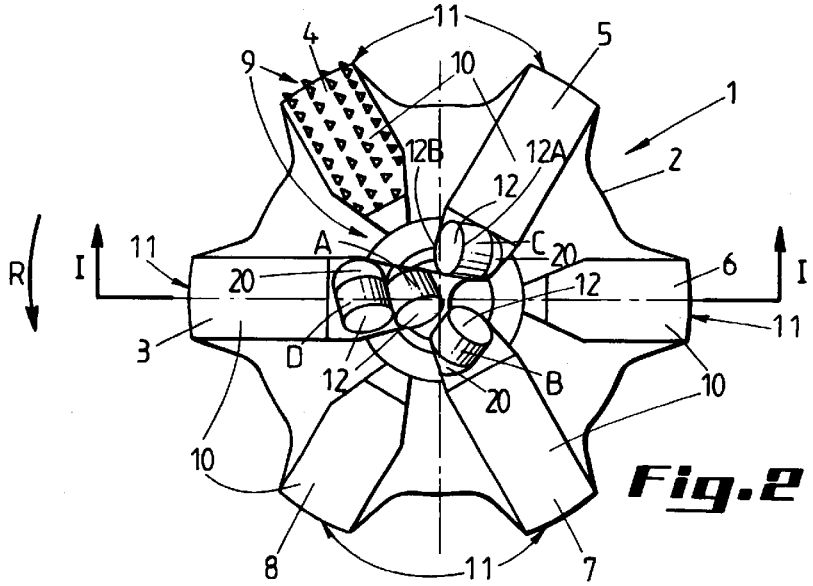
FIG. 2 is a schematic view of the front side (according to the drilling direction) of the drill bit of FIG. 1.

In the case of the example of FIGS. 1 and 2, it has been chosen to dispose, on blade 3 (FIG. 2), two cutting discs 12 carrying references A and D, on blade 5, one cutting disc 12 carrying reference C and, on blade 7, one cutting disc 12 carrying reference B. The cutting discs 12 (A, B, C and D) are projected (FIG. 1) by rotation around the rotation axis in a same axial plane in order to show the respective position of their tracks during drilling. The blades 4, 6 and 8 do not carry cutting discs 12.

Figure 3:
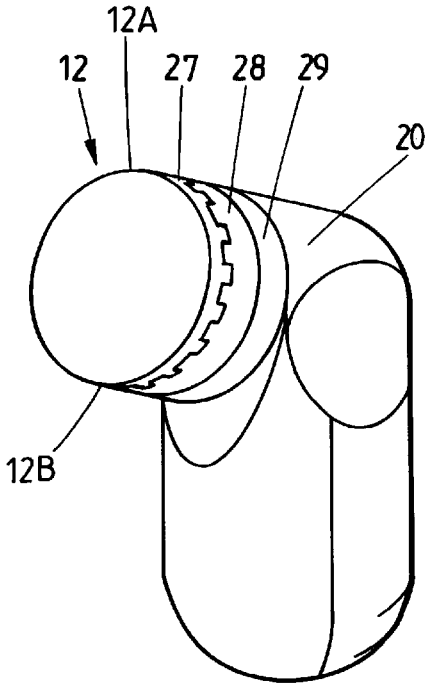
FIG. 3 is a schematic perspective elevational view of a disc stud and of its disc which can be employed in the drill bit of the invention.

As schematically shown in FIG. 2, each cutting disc 12 is fixed to a stud 20, which is known per se, the shape of which can be modified according to one's wishes (see also FIG. 3), which can be fixed into the corresponding blade, parallel to the rotation axis, and which can be arranged so that the active face of each cutting disc 12 can be inclined under a cutting angle (rake), of for example in the order of 30°, with respect to a corresponding axial plane. According to FIGS. 2 and 3, the inclination of this angle is thus directed so that the anterior cutting edge 12A of each disc 12 (according a longitudinal movement direction of the tool 1) is behind (according to the rotation direction R during drilling) with respect to the posterior cutting edge 12B of the same disc 12 in the drill bit 1. The studs 20 are advantageously made of tungsten carbide.

For the clarity of the drawings, the impregnated diamond particles and/or the thermally stable synthetic diamonds or still others are not shown in FIG. 1. In FIG. 2, they are only shown schematically on blade 4 in the form of triangles.

The blades 3, 5 and 7 can practically only differ in the number and location of the cutting discs 12. The blades 4, 6 and 8 may be similar to one another. Other arrangements of these blades 3 to 8 can also be preferred, such as the one of FIG. 10 explained hereinafter.

A practically central passage 21 can be provided for drilling liquid in such a manner that it emerges between the outer front surfaces 10 and escapes, together with the fragments caused by the drilling, through channels extending between the blades 3 to 8 and along the sides of the body 2.

Said remaining area 14 (FIG. 1) may be divided itself into two substantially circular areas 25, 26 which are coaxial to the central area 13. So, one circular area 25 or 26 may comprise practically only thermally stable synthetic diamonds whereas the other circular area 26 or 25 may comprise practically only impregnated diamond particles.

It may be preferred that the thermally stable synthetic diamonds are disposed in the circular area 26 situated directly around the central area 13.

It may also be desirable that a (not shown) intermediary annular area situated between the two circular areas 25 and 26 is partially equipped with impregnated diamond particles and partially with thermally stable synthetic diamonds.

The thermally stable synthetic diamonds may have a circular shape and/or a cubic shape and/or a prismatic shape with a preferably triangular cross-section.

At least one of the cutting discs 12 can be composed of several layers, i.e. for example:

- a layer 27 for attacking the formation to be drilled, and made of synthetic polycrystalline diamond compact,
- an intermediary layer 28 of tungsten carbide carrying this attack layer 27, and
- a layer 29 of tungsten carbide combined with diamond particles which is carried by the stud 20 and which carries the intermediary layer 28.

The blades 3 to 8 have preferably each a width which is substantially constant over an important part of their outer front surface 10 and over their outer lateral surface 11. The width of the different blades 3 to 8 may be equal. A drill bit 1 body 2 may comprise for example six blades 3 to 8. Along the cylindrical surface of the body 2, the blades 3 to 8 may extend in a straight way (FIGS. 1 and 2) or in a helical way (not shown).

The outer lateral surfaces 11 of the blades 3 to 8, which belong to a substantially cylindrical surface, may show in one embodiment on this surface a width which is in the order of up to at the most half the circular distance between two successive blades 3 to 8, measured on this substantially cylindrical surface.

The outer front surface 10 of the blades 3 to 8 is arranged to determine, by the cutting elements 9, in the formation of the bottom of a drill hole (not shown) a conical surface entering the drill bit 1 and showing preferably a cone angle between 10° and 55°, preferably in the order of 45°, with respect to the rotation axis of the drill bit 1.

The selection of the central 13 and remaining areas 14 and/or 25, 26 may depend on the formations to be drilled. So, for very hard rocks, it appears to be advantageous to chose a small diameter for the central area 13 and to increase this area to the extent that the rocks are less hard. For clay containing formations, the PDC cutting discs 12 turn out to be better thanks to their capacity to evacuate these materials: there is thus less balling up of the bit 1 at the locations of these discs 12.

The combined use of PDC cutting discs 12 and impregnated diamond particles and/or thermally stable synthetic diamonds according to the invention enables moreover to modify the density in diamond carats according to the areas 13 and 14 and/or 25, 26. By way of example, a common drill bit with only PDC discs 12, a nominal diameter of 8½" (about 216 mm) and wherein there are 60 to 80 discs of about 3 carats each, involves an investment of a total value of 200 to 250 carats in this bit. A common bit equivalent in size but with impregnated natural or synthetic diamond particles, involves an investment of a total value of 1000 to 1200 carats. Of course, this latter bit is usually used for clearly harder and more abrasive formations than the drill bit with discs 12 involving consequently a higher diamond consumption than in the case of this latter bit.

The annexed Table 1 shows by way of comparison the rate of penetration (ROP in meters per hour) of different common drill bits and of the one 1 of the invention and further the penetration rate of a core bit. These drill and core bits are of a comparable size as to their front surface attacking the formation in front thereof. They are subjected to a pressure at the bottom of the hole of the same order of magnitude (WOB=weight on bit, in the order of 40.5 to 46.6 kg/cm$^2$). The power applied to the drill bit 1 is indicated in column HP (horse power) of Table 1 and this power is indicated per surface unity y in column HP per cm$^2$. The drill bits used for the comparison are schematised in FIGS. 4 to 9. The bit of FIGS. 4 and 5 comprises twelve narrow blades, marked in accordance with their similarities by letters A, F and G and drawing a semi-toric groove by means of impregnated diamond particles whereas the centre is drilled by thermally stable synthetic diamonds situated in a drilling liquid outlet. The bit of FIGS. 6 and 7 comprises twelve narrow blades marked in accordance with their similarities with the letters A, B, C, D and E and drilling a cone in the order of 60° with respect to the rotation axis. The bit of FIGS. 8 and 9 comprises six thick blades marked in accordance with their similarities by letters A, B and C and drilling a cone in the order of 45° with respect to the rotation axis. The core bit chosen for the comparison (not shown) is only equipped with PDC cutting discs in a so-called soft bond on its front attack face. During the comparative test, the same rock has been drilled or cored with these different tools. The bond used for the drill bits of FIGS. 4 to 9 is also of the so-called soft type.

From Table 1 it appears that the bit 1 of the invention has a penetration speed (ROP) which is substantially higher than that of the other common drill bits.

It has to be understood that the invention is in no way limited to the described embodiments and that many modifications can be applied thereto without leaving the scope of the present invention.

As shown in FIG. 10, the blades 5 with a truncated triangle shaped projection 5A on the plane of the drawing can be intercalated between blades 3, 4, the width of which is practically constant over their entire outer surface. The use of these blades 5A enables for example to reduce the gap between two successive blades 3,4.

In view of the above, it will be clear that the invention can also comprise drill bits wherein all the blades show a truncated triangularly shaped projection like the blade 5A hereinabove.

TABLE 1

Figure 4:
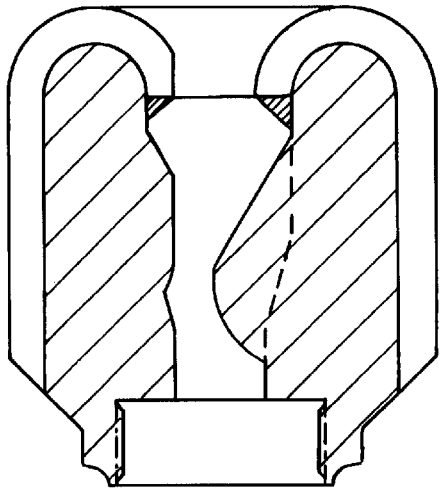
Fig.4 Prior Art
Figure 5:
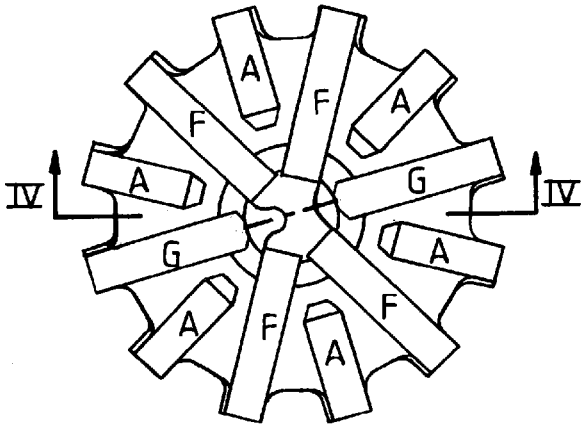
Fig.5 Prior Art
Figure 6:
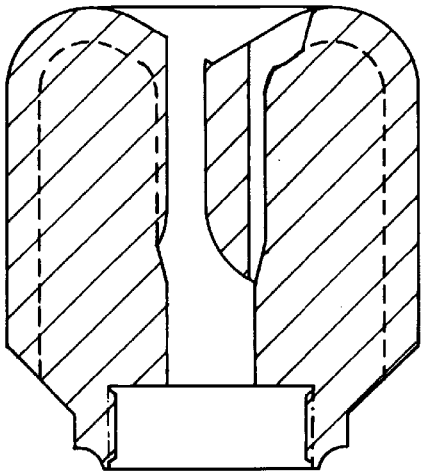
Fig.6 Prior Art
Figure 8:
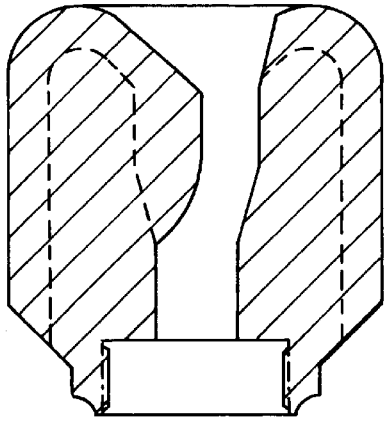
Fig.8 Prior Art
Figure 7:
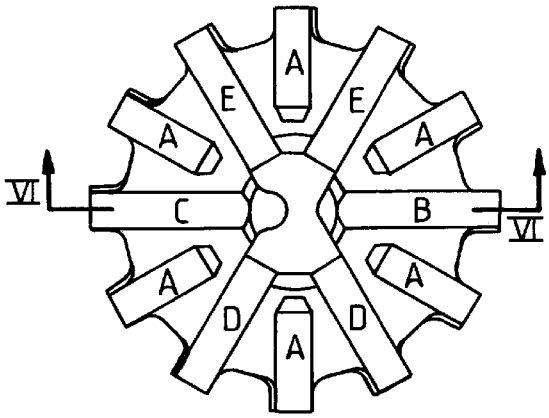
Fig.7 Prior Art
Figure 9:
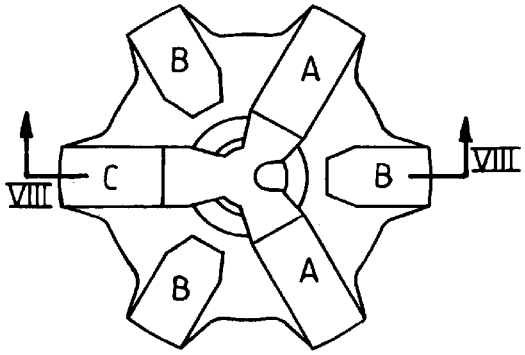
Fig.9 Prior Art

| TOOL | ROP m/hour | HP | HP/cm$^2$ | WOB kg/cm$^2$ |
|---|---|---|---|---|
| Core bit | 19.2 | 16.3 | 0.7 | 43.5 |
| Drill bit of: | | | | |
| FIGS. 4 and 5 | 1.9 | 13.5 | 0.2 | 40.5 |
| FIGS. 6 and 7 | 1.64 | 17.1 | 0.28 | 53 |
| FIGS. 8 and 9 with impregnation | 3.68 | 19.2 | 0.37 | 50 |
| FIGS. 8 and 9 without impregnation | 4.11 | 22.9 | 0.44 | 51.7 |
| Drill bit 1 of the invention | 5.06 | 31.4 | 0.60 | 46.6 |

What is claimed is:

1. A drill bit for well drilling, comprising:

a central body, said central body having a front area in a direction of drilling and a side area in a direction laterally away from a central axis of the bit rotation, cutting blades protruding from the front area and side area of said body, said cutting blades having front external surfaces on the blades protruding from the front area of said body and side external surfaces on the blades protruding from the side area of said body, cutting elements disposed over the external surfaces of said blades, at least one synthetic polycrystalline diamond compact cutting disc disposed in a central area of the front external surfaces of said blades, said central area being coaxial with said central axis of the bit rotation, and thermally stable synthetic diamonds and impregnated diamond particles disposed on a remaining area of the front external surfaces of said blades outside said central area characterized in that said remaining area of said front external surfaces is divided into first and second coaxial circular areas that are coaxial with said central area and wherein said first coaxial circular area is provided with cutters comprised of the thermally stable synthetic diamonds and said second coaxial circular area is provided with cutters comprised of the impregnated diamond particles.

2. A drill bit according to claim 1 wherein said first circular area is situated directly adjacent said central area and said thermally stable synthetic diamonds are disposed in said first circular area.

3. A drill bit according to any one of claims 1 or 2 characterized in that the thermally stable synthetic diamonds have at least one of a circular shape and a cubic shape and a prismatic shape and a prismatic shape with a triangular cross-section.

4. A drill bit according to claim 3, characterised in that the synthetic polycrystalline diamond compact discs are carried by orientation studs of tungsten carbide.

5. A drill bit according to claim 3, characterised in that at least one of said discs is a multilayered element, one layer of which, is a synthetic polycrystalline diamond compact (PDC), and another layer of which is a tungsten carbide material.

6. A drill bit according to claim 3, characterised in that at least one of the blades has a substantially constant width over a major portion of its front external surfaces and over a major portion of its side external surfaces.

7. A drill bit according to claim 3, characterised in that each blade has a width of approximately half the circular distance between two adjoining blades.

8. A drill bit according to claim 3, characterised in that at least one blade has, according to a projection into a plane perpendicular to the central axis of the drill bit, the shape of a truncated triangle pointing towards said axis.

9. A drill bit according to claim 3, characterised in that the front external surface of the blades is arranged with a conical recess for forming a convex conical surface at the bottom of the borehole, such conical surface showing a cone angle of between 10° and 55° with respect to the central axis of the drill bit.

10. A drill bit according to any one of claims 1 or 2, characterized in that the synthetic polycrystalline diamond compact discs are carried by orientation studs of tungsten carbide.

11. A drill bit according to claim 10, characterised in that at least one of said discs is a multilayered element, one layer of which, is a synthetic polycrystalline diamond compact (PDC), and another layer of which is a tungsten carbide material.

12. A drill bit according to claim 10, characterised in that at least one of the blades has a substantially constant width over a major portion of its front external surfaces and over a major portion of its side external surfaces.

13. A drill bit according to claim 10, characterised in that each blade has a width of approximately half the circular distance between two successive blades.

14. A drill bit according to claim 10, characterised in that at least one blade has, according to a projection into a plane perpendicular to the rotation axis of the drill bit, the shape of a truncated triangle pointing towards this axis.

15. A drill bit according to claim 10, characterised in that the front external surface of the blades is arranged with a conical recess for forming a convex conical surface at the bottom of the borehole, such conical surface showing a cone angle of between 10° and 55° with respect to the rotation axis of the drill bit.

16. A drill bit according to any one of claims 1 or 2, characterized in that at least one of said discs is a multilayer element, one layer of which, is a synthetic polycrystalline diamond compact (PDC), and another layer of which is a tungsten carbide material.

17. A drill bit according to claim 16, characterised in that at least one of the blades has a substantially constant width over a major portion of its front external surface and over a major portion of its surface.

18. A drill bit according to claim 16, characterised in that each blade has a width of approximately half the circular distance between two adjacent blades.

19. A drill bit according to claim 16, characterised in that at least one blade has, according to a projection into a plane perpendicular to the rotation axis of the drill bit, the shape of a truncated triangle pointing towards said axis.

20. A drill bit according to claim 16, characterised in that the front external surface of the blades is arranged with a conical recess for forming a convex conical surface at the bottom of the borehole, such conical surface showing a cone angle of between 10° and 55° with respect to the rotation axis of the drill bit.

21. A drill bit according to any one of claims 1 or 2, characterized in that at least one of the blades has a substantially constant width over its front external surfaces and over its side external surfaces.

22. A drill bit according to claim 21, characterised in that on said substantially cylindrical surface, each blade has a width of approximately half the circular distance between two adjacent blades.

23. A drill bit according to claim 21, characterised in that the front external surface of the blades is arranged with a conical recess for forming a convex conical surface at the bottom of the borehole, such conical surface showing a cone angle of between 10° and 55° with respect to the rotation axis of the drill bit.

24. A drill bit according to any one of claims 1 or 2, characterized in that the thickness of a blade is approximately equal to half the circular distance between two adjacent blades on said body.

25. A drill bit according to claim 24, characterised in that the front external surface of the blades is arranged with a conical recess for forming a convex conical surface at the bottom of the borehole, such conical surface showing a cone angle of between 10° and 55° with respect to the rotation axis of the drill bit.

26. A drill bit according to any one of claims 1 or 2, having at least one blade that reduces in width along its front external surface in a direction toward said central axis of the bit rotation.

27. A drill bit according to claim 26, characterized in that substantially constant width blades are alternated with blades that reduce in width.

28. A drill bit according to claim 27, characterised in that the front external surface of the blades is arranged with a conical recess for forming a convex conical surface at the bottom of the borehole, such conical surface showing a cone angle of between 10° and 55° with respect to the rotation axis of the drill bit.

29. A drill bit according to claim 26, characterised in that there is provided between two blades with a substantially constant width over their front external surfaces (10) and side external surfaces a blade that reduces in width along its front external surface in a direction toward said central axis of the bit rotation.

30. A drill bit according to claim 26, characterised in that the front external surface of the blades is arranged with a conical recess for forming a convex conical surface at the bottom of the borehole, such conical surface showing a cone angle of between 10° and 55° with respect to the rotation axis of the drill bit.

31. A drill bit according to any one of claims 1 or 2, characterized in that the front external surface of the blades is arranged with a conical recess for forming a convex conical surface at the bottom of the borehole, such conical surface showing a cone angle of between 10° and 55° with respect to the rotation axis of the drill bit.

* * * * *